US006886555B2

(12) United States Patent
Lee

(10) Patent No.: US 6,886,555 B2
(45) Date of Patent: May 3, 2005

(54) FIREPLACE GRATE

(76) Inventor: James F. Lee, 42-06 220th St., Bayside, NY (US) 11361

( * ) Notice: Subject to any disclaimer, the term of this patent is extended or adjusted under 35 U.S.C. 154(b) by 0 days.

(21) Appl. No.: 09/836,995

(22) Filed: Apr. 18, 2001

(65) Prior Publication Data

US 2002/0153002 A1 Oct. 24, 2002

(51) Int. Cl.[7] ..... F24B 1/193
(52) U.S. Cl. ..... 126/541; 126/152 B; 126/298
(58) Field of Search ..... 126/540, 541, 126/542, 298, 152 R, 152 A, 152 B, 153, 163 A, 167, 168, 163 R, 500, 25 B; 44/265, 535

(56) References Cited

U.S. PATENT DOCUMENTS

| | | | | | |
|---|---|---|---|---|---|
| 2,519,482 | A | * | 8/1950 | Kutchera | 126/542 |
| 2,926,657 | A | * | 3/1960 | Ford | 126/542 |
| 3,508,536 | A | | 4/1970 | McEwan | 126/541 |
| 3,543,741 | A | * | 12/1970 | Whitehead | 126/92 R |
| 3,670,714 | A | * | 6/1972 | Eyges | 126/541 |
| 4,257,392 | A | * | 3/1981 | Betenbaugh | 126/541 |
| 4,305,375 | A | * | 12/1981 | George | 126/540 |
| 4,360,001 | A | * | 11/1982 | Thompson | 126/298 |
| 4,450,827 | A | * | 5/1984 | Love | 44/265 |
| 4,692,168 | A | * | 9/1987 | Dotson et al. | 126/512 |
| 4,838,781 | A | * | 6/1989 | Fischer | 126/152 B |
| 5,435,295 | A | * | 7/1995 | Gerrard | 126/541 |
| D369,404 | S | | 4/1996 | Vestal, Sr. | D23/398 |
| D373,186 | S | | 8/1996 | Bain | D23/398 |
| 5,636,624 | A | | 6/1997 | Cassidy | 126/540 |
| 5,722,389 | A | | 3/1998 | Cranberg | 126/540 |
| 5,839,427 | A | | 11/1998 | Shorts | 126/152 B |
| 5,842,465 | A | | 12/1998 | Cassidy | 126/540 |
| 6,055,978 | A | | 5/2000 | Ellis | 126/541 |
| 6,102,032 | A | | 8/2000 | Sebby et al. | 126/540 |
| 6,363,927 | B2 | * | 4/2002 | Haynes et al. | 126/152 B |

FOREIGN PATENT DOCUMENTS

| | | | | |
|---|---|---|---|---|
| FR | 2 380 498 A | * | 10/1978 | |
| GB | 0011447 A | * | 5/1893 | 126/541 |

OTHER PUBLICATIONS

WEBSTER's II New Riverside University Dictionary, The Riverside Publishing Company, 1984, pp 900–901.*
Printed internet page from Duraflame® web site (http://www.duraflame.com/Products/Tools/usagetips.cfm).

* cited by examiner

*Primary Examiner*—Josiah C. Cocks
(74) *Attorney, Agent, or Firm*—Morgan & Finnegan, LLP

(57) ABSTRACT

The fireplace grate comprises a frame defining a compartment to hold a firelog or starter material and to prevent direct contact between the firelog or starter material and wood or ceramic logs placed on top of the frame. In one embodiment, the fireplace grate includes a hingeable door or member for the insertion of the firelog. In an alternative embodiment, the fireplace grate includes pivot arms for pivoting a ceramic log over the firelog in the compartment.

22 Claims, 8 Drawing Sheets

FIREPLACE GRATE

BACKGROUND OF THE INVENTION

1. Field of Invention

The present invention generally relates to a fireplace grate, and more particularly, to a fireplace grate designed for safety to protect a firelog, such as, for example, a gel log, from being crushed by wood or ceramic logs, or from falling through the traditional fireplace grate.

2. State of the Current Art

Within the past twenty years, firelogs, such as, for example, Duraflame® (Stockton, Calif.), have been introduced for use in home fireplaces. The firelogs were intended to be used in place of wood. However, some homeowners use both firelogs and wood or ceramic logs together in a fireplace, despite explicit instructions by the manufacturers written on the firelog packaging not to burn both at the same time.

Firelogs are made from a combination of sawdust and blended wax. As a firelog reaches the end of its burning capacity, it begins to fall apart, creating a flare-up of the chemicals and materials of which it is composed. Also, natural firewood has a tendency to pop. This burst of air could cause a firelog to break apart and flare-up. When a flare-up occures, flames can consume the fireplace and block the flue. Smoke would not be able to exit the fireplace by the chimney and would begin to pour out the front of the fireplace. Therefore, burning both the firelog and wood logs together potentially causes a safety hazard for the homeowner.

Current designs of fireplace grates have not kept up with the introduction of the new firelog into the market. For example, current fireplace grates are not designed to support a firelog or protect the firelog from being crushed. For example, the spacing of the metal rods on the traditional grate is too far apart to support the gel log. Some manufacturers of firelogs state on their wrappers that the firelogs should be supported by at least four grate bars. With this support, as the firelog burns, it loses rigidity and falls apart, causing flare-up.

Most fireplace grates are also too low to the ground to allow the firelog to fit under the grate, putting distance between the firelog and wood logs. As a result, the firelogs are damaged, causing it to break open and flare up. This can occur when a wood log leans against or falls on the firelog while it is burning.

In addition, when wood logs are placed around and on top of the firelog, heat is trapped and the firelog is smothered, causing an unsafe condition that could melt the firelog. Further, homeowners have a tendency to poke at the wood logs with fireplace tools. These fireplace tools can easily break apart a burning firelog and current fireplace grates do not protect firelogs from these tools. Both of these conditions can cause a hazardous fire condition within the home.

Therefore, there is a need for a fireplace grate designed with safety considerations to support the burning firelog in such a way that it will not fall through the grate. The grate should also be designed to protect the firelog from being crushed by wood or ceramic logs. Finally, the grate should be designed to allow efficient airflow to the firelog and wood logs and reduce heat build-up around the firelog.

SUMMARY OF THE INVENTION

The invention provides a fireplace grate that overcomes these problems. The fireplace grate provides protection to a firelog from being crushed or smothered by wood or ceramic logs.

The fireplace grate comprises a frame defining a compartment to hold a firelog or starter material and to prevent direct contact between the firelog or starter material and wood or ceramic logs placed on top of the frame. In one embodiment, the fireplace grate includes a hingeable door or member for the insertion of the firelog or starter material. In an alternative embodiment, the fireplace grate includes pivot arms for pivoting a ceramic log over the firelog or starter material in the compartment.

DETAILED DESCRIPTION OF THE EMBODIMENTS

Turning now to the drawings, there are illustrated various fireplace grates designed to support and protect a firelog from being crushed by wood or ceramic logs used in a fireplace.

Figure 1:
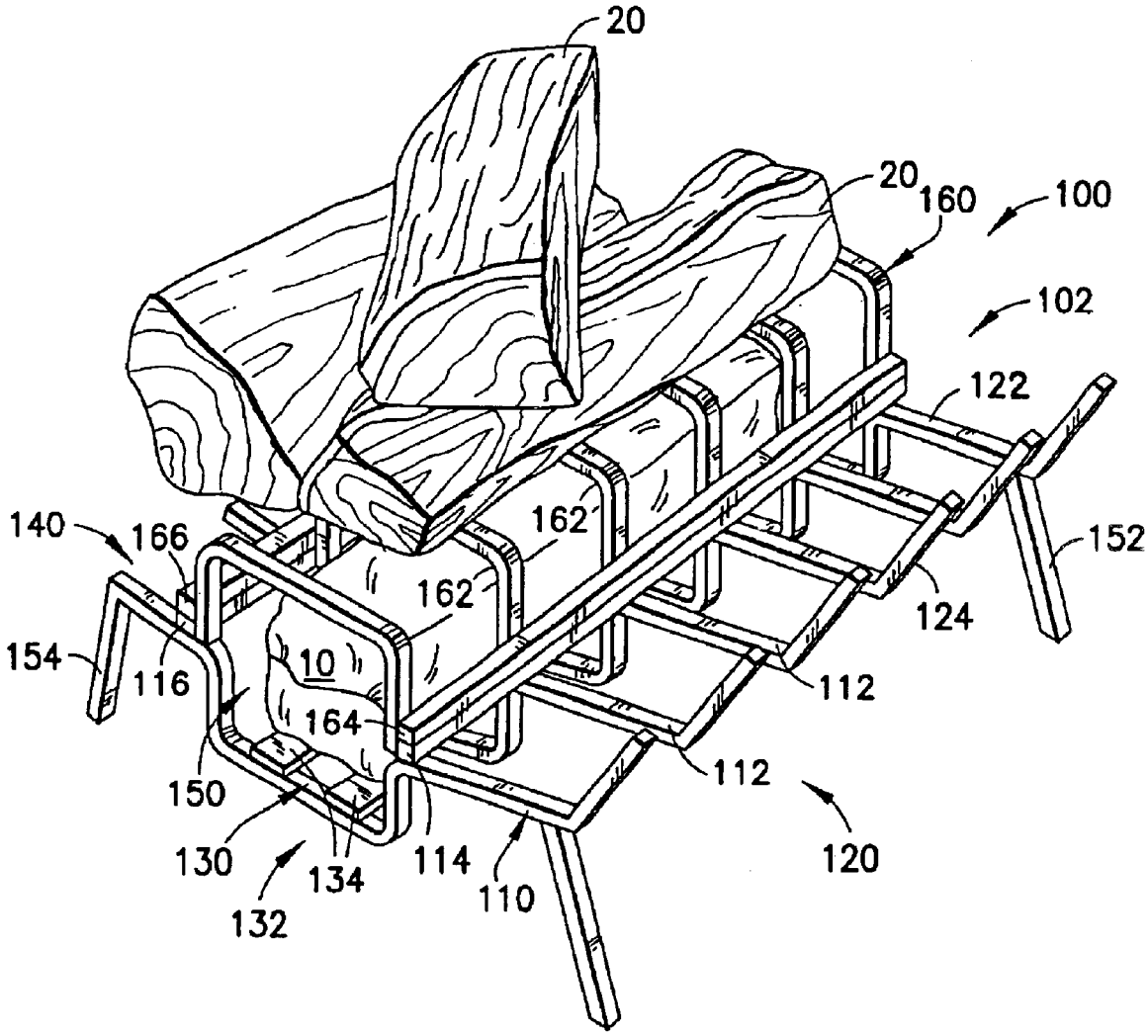
FIG. 1 is a perspective view of one embodiment of the fireplace grate.

Referring first to FIG. 1, a fireplace grate 100 comprises a frame 102 including a base 110 and an upper cage member 160. The base 110 and upper cage member 160 define a cavity or compartment 150 for holding a firelog or starter material 10. The compartment 150 isolates the firelog or starter material from wood or ceramic logs 20 placed on top of the frame 102, preventing the firelog or starter material from being crushed or smothered by the wood or ceramic logs. The firelog may include, for example, a starter brick or gel log. In another embodiment, the compartment 150 can hold a starter material such as, for example, newspaper, kindling, cardboard, or the like.

The base 110 includes a plurality of substantially identical grate members 112 which are spaced in a parallel relation. Although, in alternative embodiments, the grate members 112 are not substantially identical. The plurality of grate members 112 are connected to two longitudinally extending cross members 114, 116 for stability and rigidity. The grate members 112 and cross members 114, 116 are solid metal castings formed of, for example, cast iron and can have, for example, rectangular or circular cross-sections.

The front portion 120 of each grate member 112 extends outwardly and then upwardly from the first cross member 114. The outwardly extending portion 122 of the grate members 112 in the front portion 120 defines a supporting platform for holding, longitudinally, wood or ceramic logs 20 in selected positions while the upwardly extending portion 124 of the grate members 112 in the front portion 120 prevent the wood or ceramic logs 20 from falling off the front of the fireplace grate 100.

Figure 2:
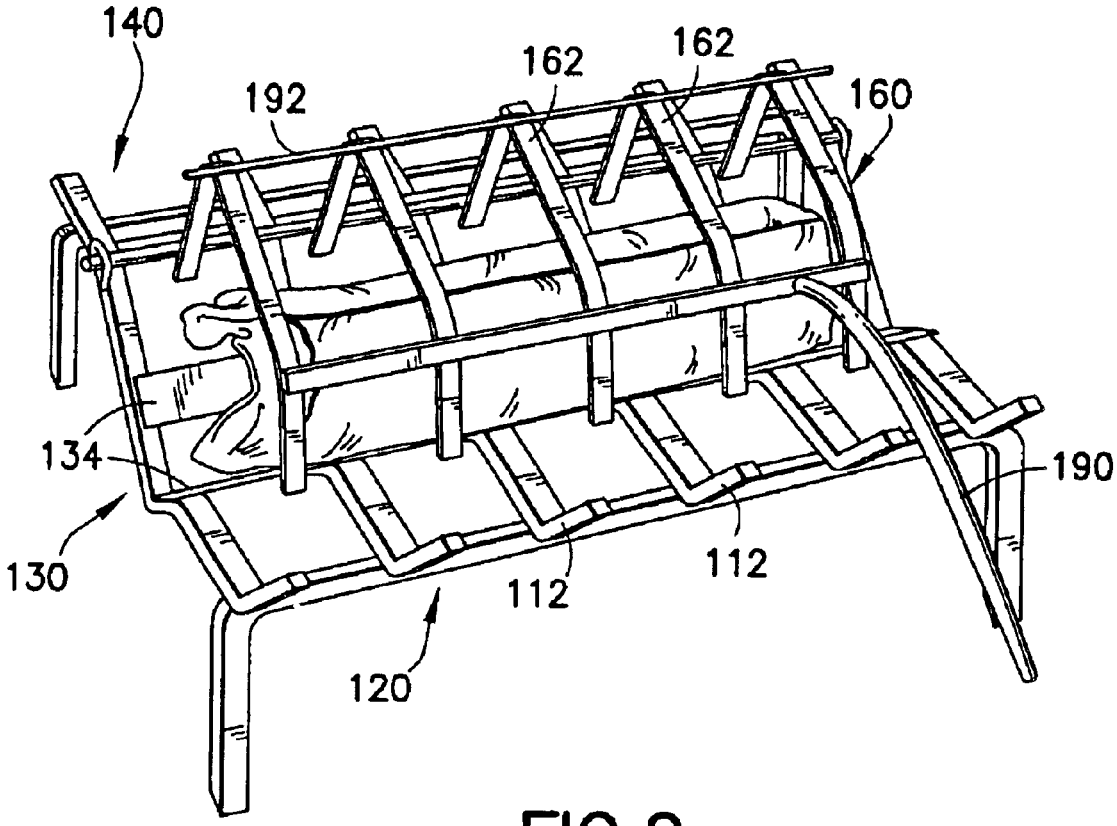
FIG. 2 is a perspective view of a second embodiment of the fireplace grate.

Between the two cross members 114, 116, the plurality of grate members 112 form a U-shaped, three-sided, portion 130 for holding the firelog 10. At the base 132 of the U-shaped portion 130 of the grate members 112 between the cross members 114, 116, two flat supporting members 134 extend longitudinally to further support the firelog 10. These flat supporting members 134 prevent the firelog from falling through the grate members 112 as the firelog loses rigidity and begins to fall apart. In an alternative embodiment, the portion of the frame between the cross members is V-shaped or two sided, as illustrated in FIG. 2, or is any other shape that securely holds the firelog and prevents the firelog from falling through the grates.

The rear portion 140 of each grate member 112 extends outwardly from the second cross member 116 to provide a supporting platform for holding additional wood or ceramic logs 10. The rear portion 140 extends towards and contacts the rear of a fireplace when installed in a traditional fireplace to prevent the wood or ceramic logs 10 from falling off the back of the fireplace grate. In an alternative embodiment, ends of the rear portion 140 of the frame may insert into recesses formed in a back wall of a fireplace. The rear portion 140 of each grate members 112 can also extend upwardly to prevent the wood or ceramic logs 10 from falling off the rear of the fireplace grate 100.

Front legs 152 join the grate members 112 in the front portion 120 of the frame at approximately the midpoint of the grate members 112. Back legs 154 are provided at the rear portion 140 of the frame. Although, it is contemplated that front or back legs 152, 154 can join the grate members 112 in the front and back portions 120, 140, respectively, of the frame they may be joined at any intermediate point, provided the stability of the fireplace grate is not sacrificed. The front and back legs 152, 154 lift the base 110 off the floor of a fireplace.

The upper cage member 160 includes a plurality of inverted U-shaped, or, alternatively, V-shaped, grate members 162 spaced in a parallel relation. The plurality of grate members 162 are connected to two longitudinally extending cross members 164, 166 for stability and rigidity. The upper cage member 160 is positioned over the U-shaped, or, alternatively, V-shaped, portion 130 of the grate members 112 of the base 110 to form the cavity or compartment 150 which separates the firelog 10 and prevents the firelog from directly contacting the wood or ceramic logs 20 placed on top of the U-shaped grate members 162 of the cage member 160 or on top of the front and rear portions 120, 140 of the grate members 112 of the base 110. This compartment draws attention to protecting the firelog and restricts access to the firelog from being crushed, broken open or poked at by fireplace tools.

In one embodiment, the cross members 164, 166 of the upper cage member 160 rest on top of the cross members 114, 116, respectively of the base 110. In alternate embodiments, the cage member 160 is hingeably attached to the base 110 to permit insertion of the firelog 10 into the cavity or compartment 150 while in an open position.

A removable handle 190, as illustrated in FIG. 2, may be used for raising and lowering the upper cage member 160 hinged to the base 110 to prevent a person from burning or dirtying their hands. An additional cross member 192, illustrated in FIG. 2, extending longitudinally and attached the top of the U-shaped or V-shaped grate members 162 of the upper cage member 160 may also be provided to prevent wood or ceramic logs 20 which are placed horizontally with respect to the frame from falling through the grate members 162 and crushing or smothering the firelog 10.

The cavity or compartment 150 formed by the upper cage member 160 and U-shaped portion 130 of the frame should provide for a space to enhance burning and complete combustion of the firelog. It is preferred that the space be provided between the top of the firelog and the cage member for efficient airflow and reduced heat buildup.

Figure 3:
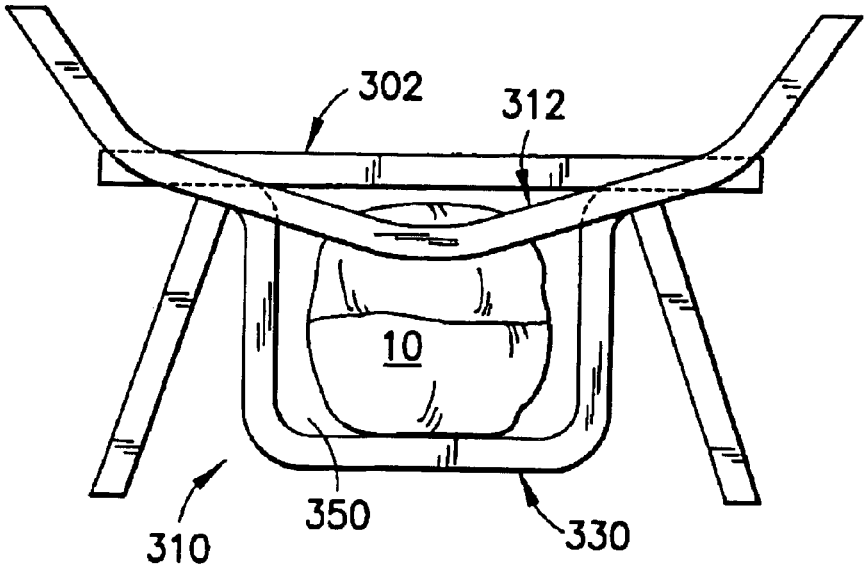
FIG. 3 is a side view of a third embodiment of the fireplace grate.

In another embodiment, illustrated in FIG. 3, a fireplace grate 300 includes a removable grate 302 covering a U-shaped portion 330 formed by a plurality of grate members 312 of a base 310. The removable grate 302 defines a flat platform for supporting wood or ceramic logs. The U-shaped portion 330 of the base 310 in this embodiment defines a compartment 350 which contains the entire firelog 10.

Figure 4A:
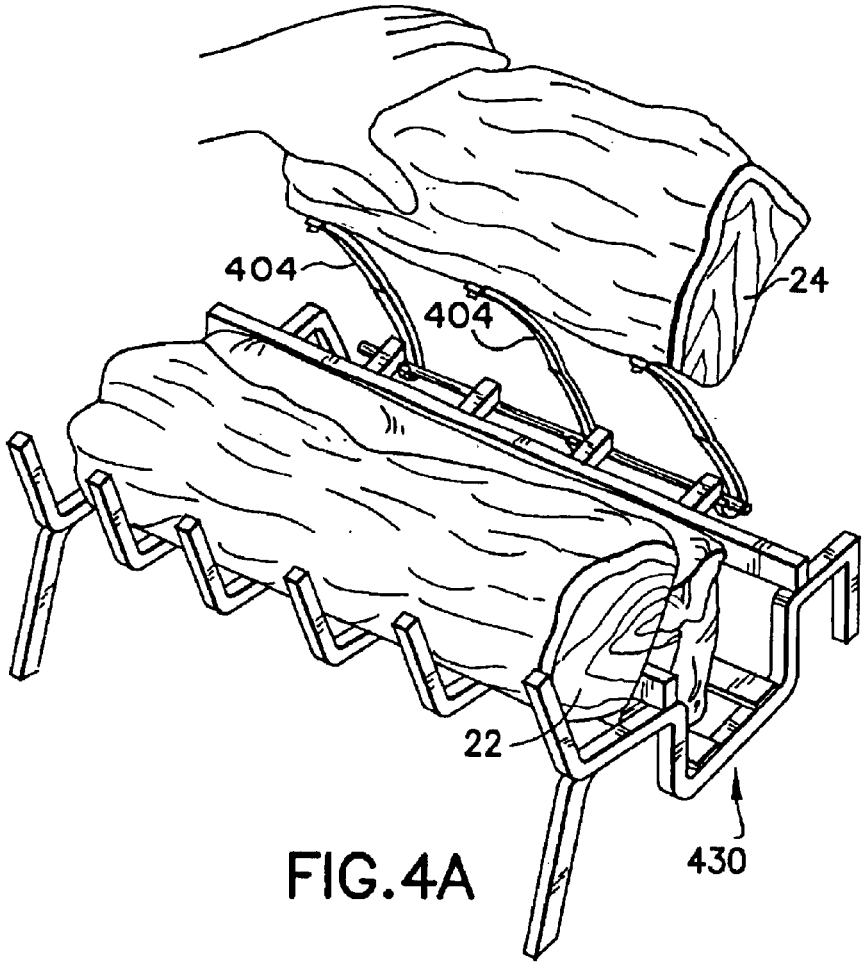
FIG. 4A is a perspective view of a fourth embodiment of the fireplace grate illustrating an open position of a second ceramic log.
Figure 4B:
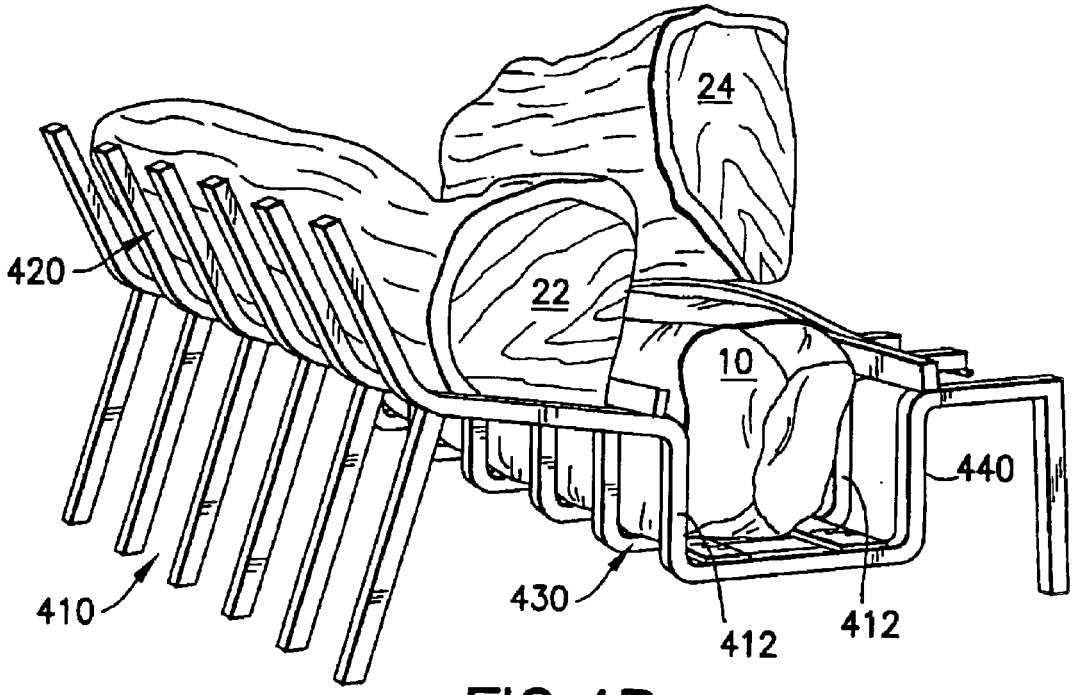
FIG. 4B is another perspective view of the fourth embodiment of the fireplace grate illustrating a closed position of the second ceramic log.

In another embodiment, illustrated in FIGS. 4A and 4B, ceramic logs 22, 24 are arranged and positioned on the base 410 to define a compartment or cavity 250 for the firelog 10. In one arrangement, the first ceramic log 22 is positioned on the front portion 420 of the grate members 412 of the base 410. The second ceramic log 24 is hinged to the rear portion 440 of the grate members 412 of the base 410 by a plurality of support members 404. In an open position, illustrated in FIG. 4A, a firelog 10 can be inserted onto the U-shaped portion 430 of the grate members 412 of the base 410. In a closed position, illustrated in FIG. 4B, the second ceramic log is positioned over the firelog providing a space for efficient air flow.

Figure 5A:
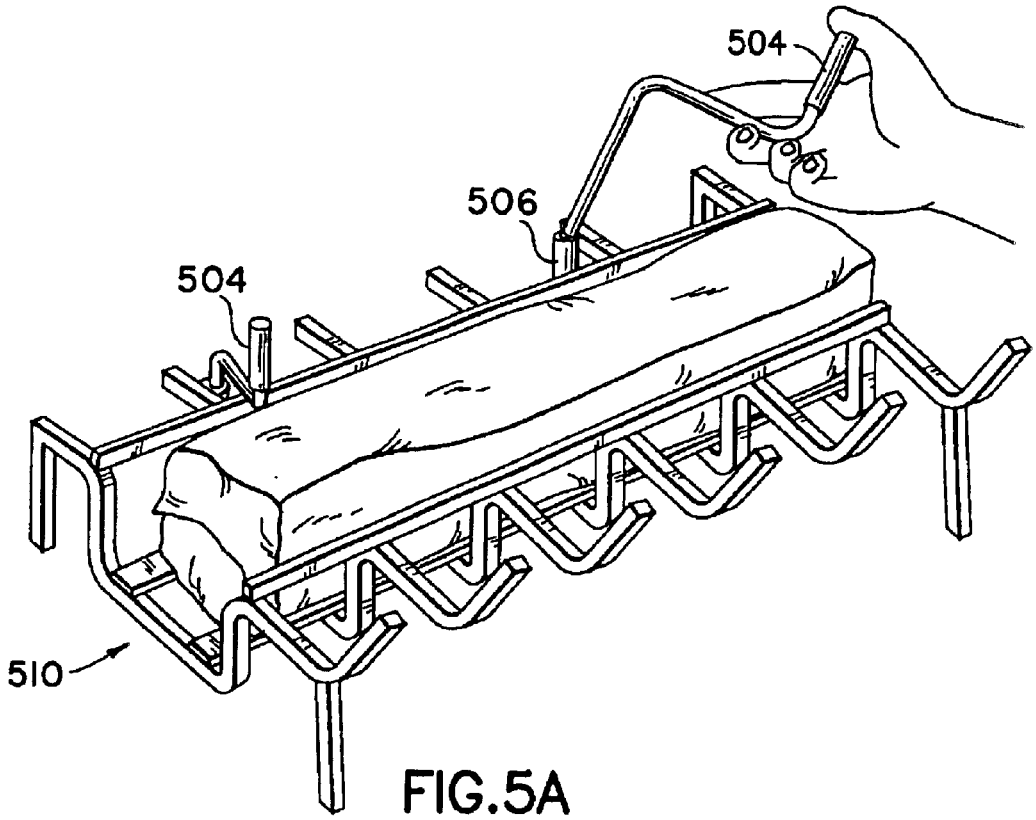
FIG. 5A is a perspective view of a fifth embodiment of the fireplace grate illustrating pivot arms for pivoting a ceramic log.
Figure 5B:
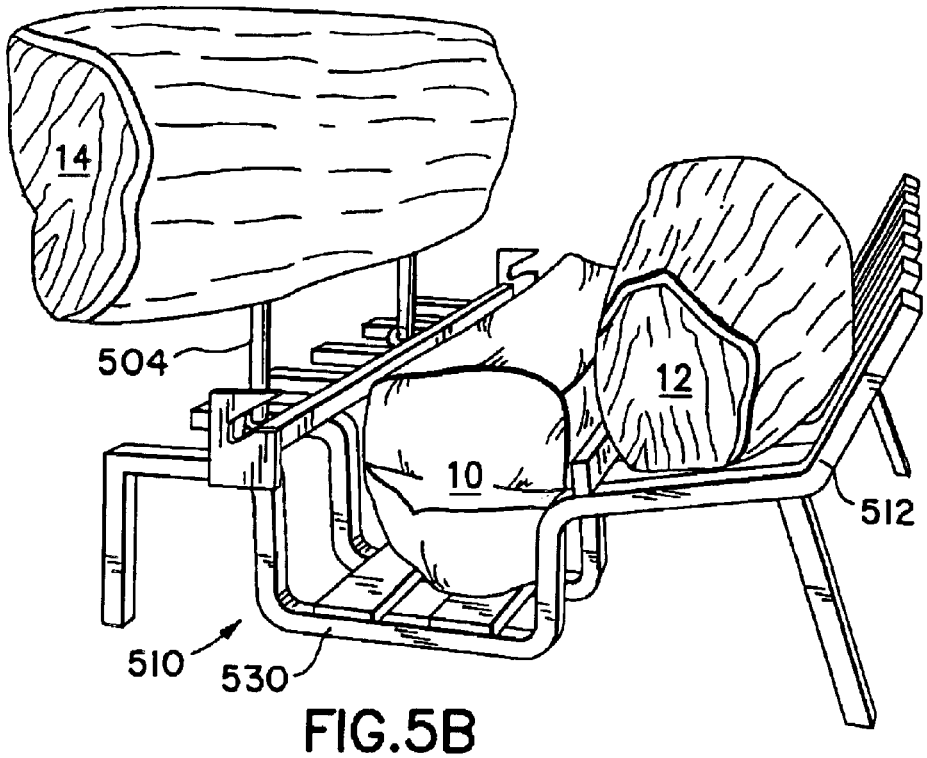
FIG. 5B is another perspective view of the fifth embodiment of the fireplace grate illustrating an open position of a second ceramic log.
Figure 5C:
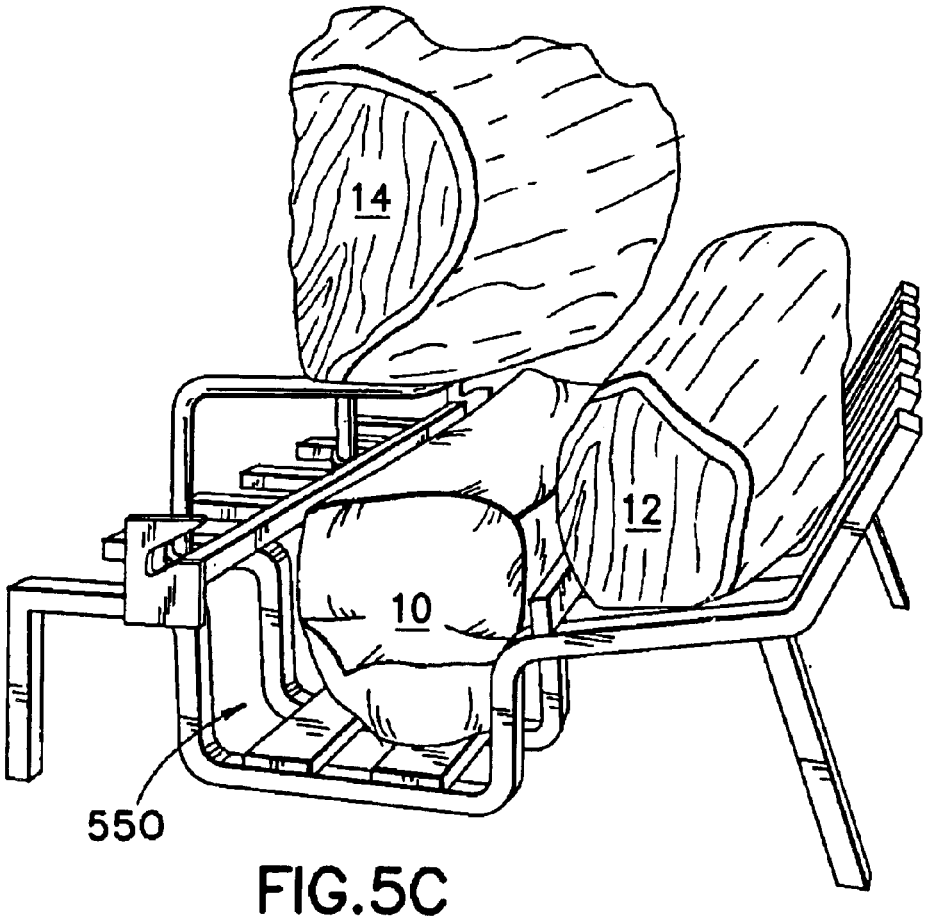
FIG. 5C is another perspective view of the fifth embodiment of the fireplace grate illustrating a closed position of the second ceramic log.

In another embodiment, illustrated in FIGS. 5A–5C, the second ceramic log 14 is inserted onto pivot arms 504 supported by sleeves 506 mounted on the base 510. The pivot arms 504 pivot or swing the second ceramic log 14 between at least two positions. One position, as illustrated in FIG. 5B, places the second ceramic log 14 over the firelog 10 while providing a compartment 550 for the firelog 10 and space for efficient airflow and reduced heat buildup. A second position, as illustrated in FIG. 5C, provides an opening for the firelog 10 to be inserted into the U-shaped portion 530 of grate members 512 of base 510.

Figure 6A:
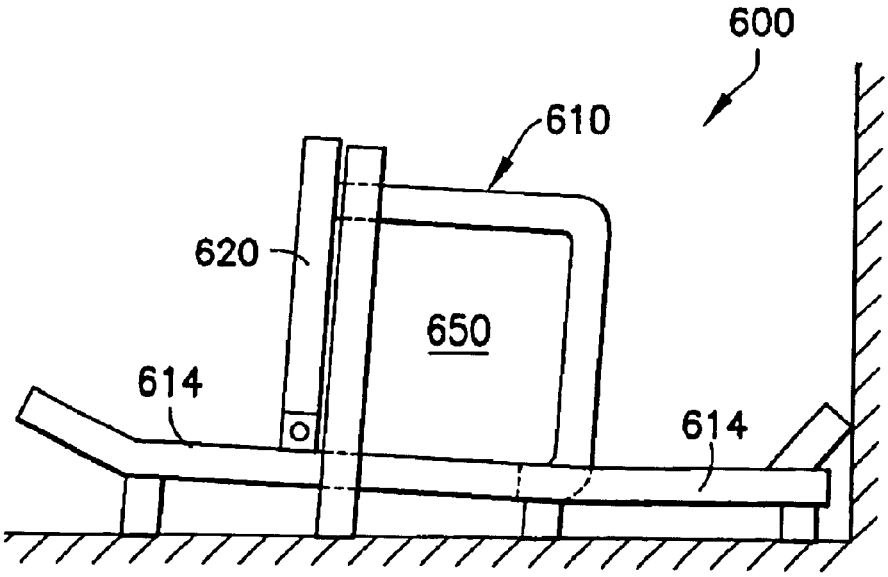
FIG. 6A is a side view of a sixth embodiment of the fireplace grate.
Figure 6B:
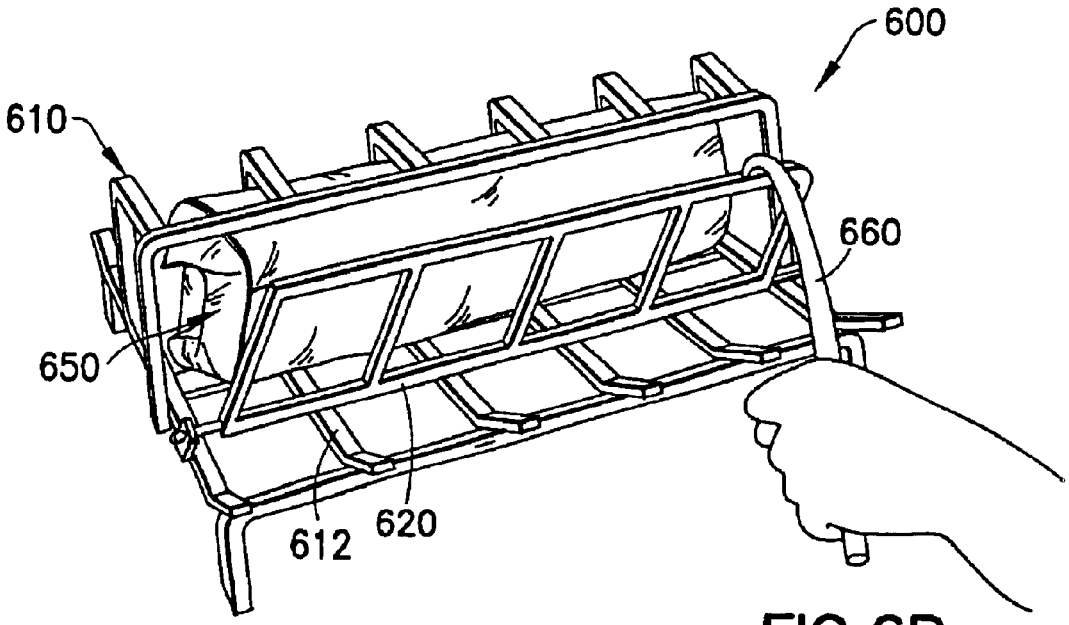
FIG. 6B is a perspective view of the sixth embodiment of the fireplace grate illustrating a hingeable door.
Figure 6C:
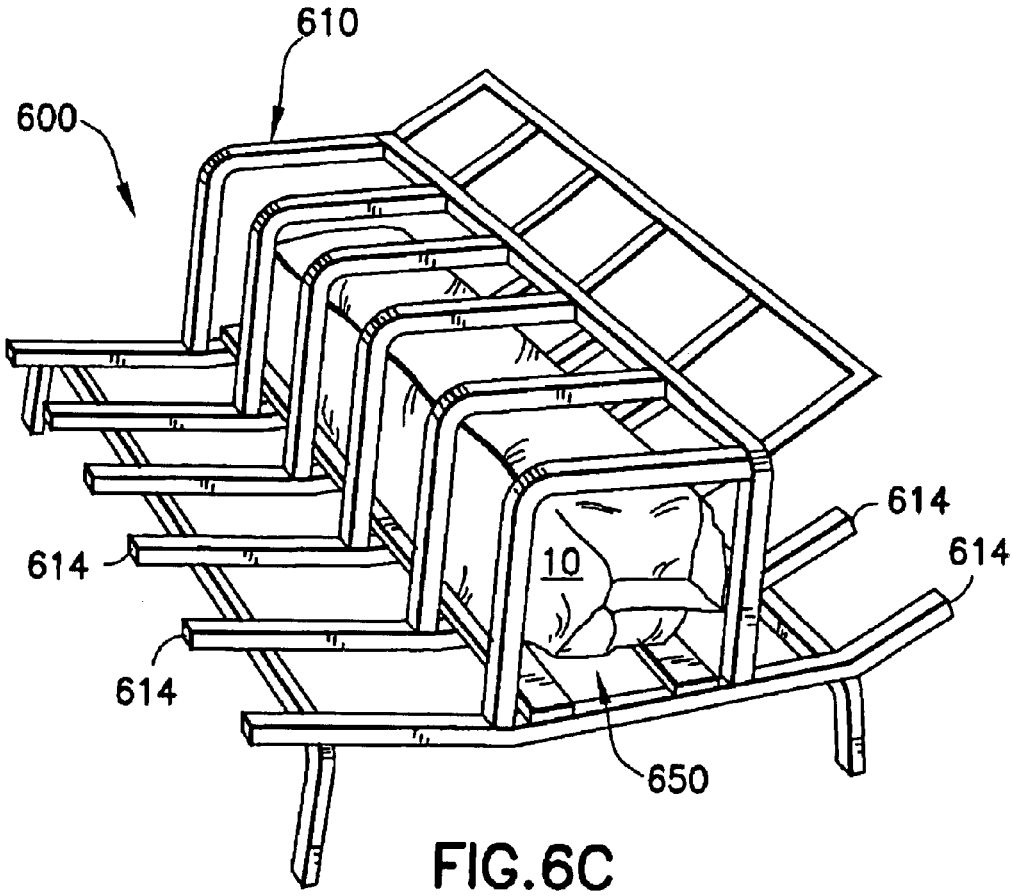
FIG. 6C is another perspective view of the sixth embodiment of the fireplace grate illustrating an extension of the top of a cage holding a firelog.

In another embodiment illustrated in FIGS. 6A–6C, a fireplace grate 600 includes a cage 610 including grate members 612. In one embodiment, the cage 610 is square shaped, although any shape can be used as long as it defines a compartment or cavity 650 for holding a firelog. As illustrated in FIG. 6C, the top of the metal cage 610 may be extended toward the front of the fireplace grate 600 and angled upwardly to provide more stability to diagonally or horizontally placed wood or ceramic logs with respect to the frame.

As illustrated in FIG. 6A, grate members 614 extend outwardly from the front and back of the cage 610 and provide a platform for wood or ceramic logs. In one embodiment, the grate members 614 angles upwardly in the front and back of the fireplace grate 600.

The cage 610 also includes a hinged door 620 facing the front of the grate which opens and closes to define a compartment 650 for the insertion of a firelog 10 into the cage 610. A removable handle 660 may be attachable to the door 620 for raising and lowering the door 620.

In alternative embodiments illustrated in FIGS. 7A–7D, a fireplace grate 700 includes a plurality of grate members 712 which are spaced in a parallel relation and define a platform for supporting wood or ceramic logs. The grate members 712 define at least one diagonally positioned U-shaped, or alternatively V-shaped, compartment 750 for holding firelog below the platform formed by the grate members 712. The firelog inserted into the compartment 750 formed by the grate members 712 is prevented from being crushed or smothered by wood or ceramic logs which are typically placed longitudinally on top of the grate members. The compartment 750 extends downwardly from the platform to permit insertion of the firelog and also allow space between the top of the firelog and the platform to ensure efficient airflow and reduced heat buildup. The U-shaped compartment may also include two flat members 734 extending longitudinally with respect to the compartment for securely holding the firelog in the compartment 750.

Figure 7A:
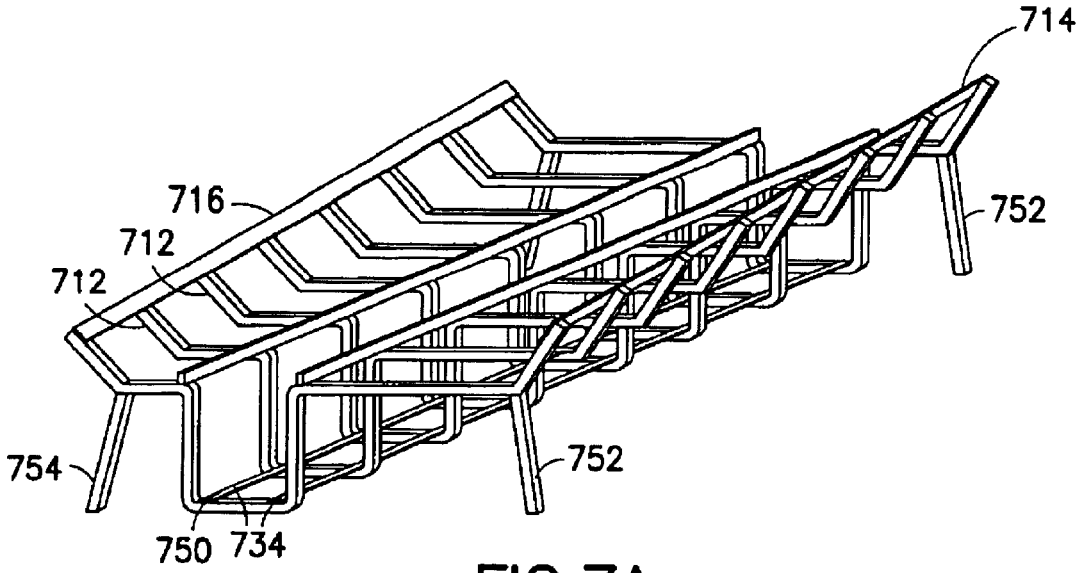
FIG. 7A is a perspective view of a seventh embodiment of the fireplace grate.
Figure 7B:
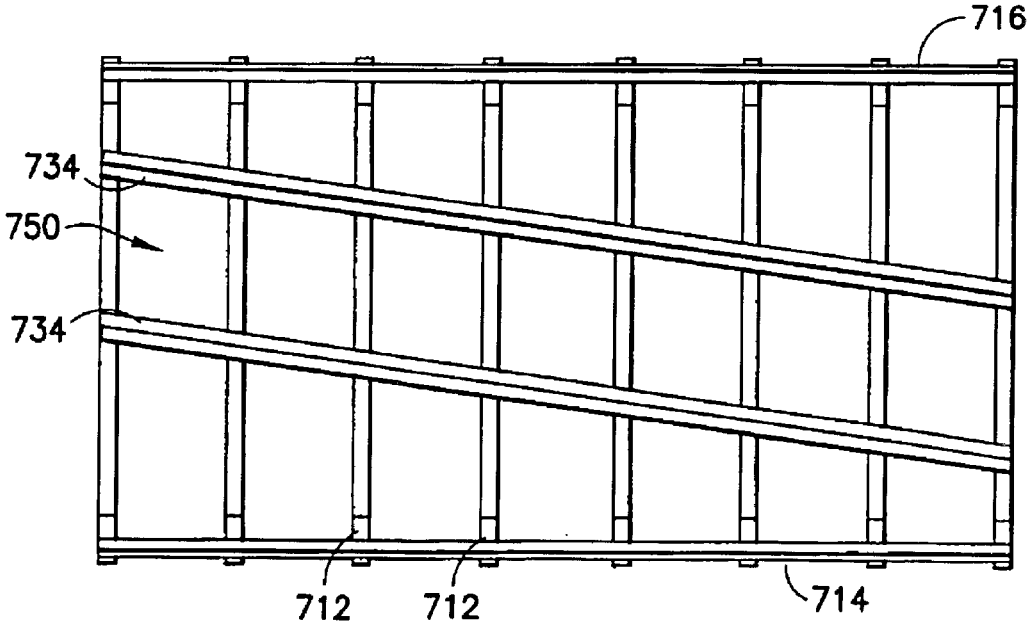
FIG. 7B is a top view of the seventh embodiment shown in FIG. 7A illustrating one compartment for a firelog.
Figure 7C:
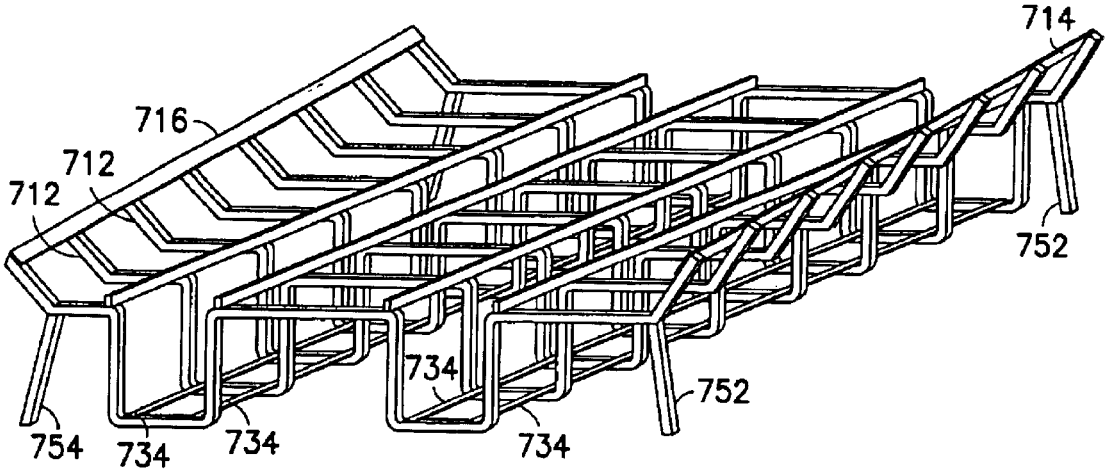
FIG. 7C is a perspective view of an eighth embodiment of the fireplace grate illustrating two compartments for firelog.
Figure 7D:
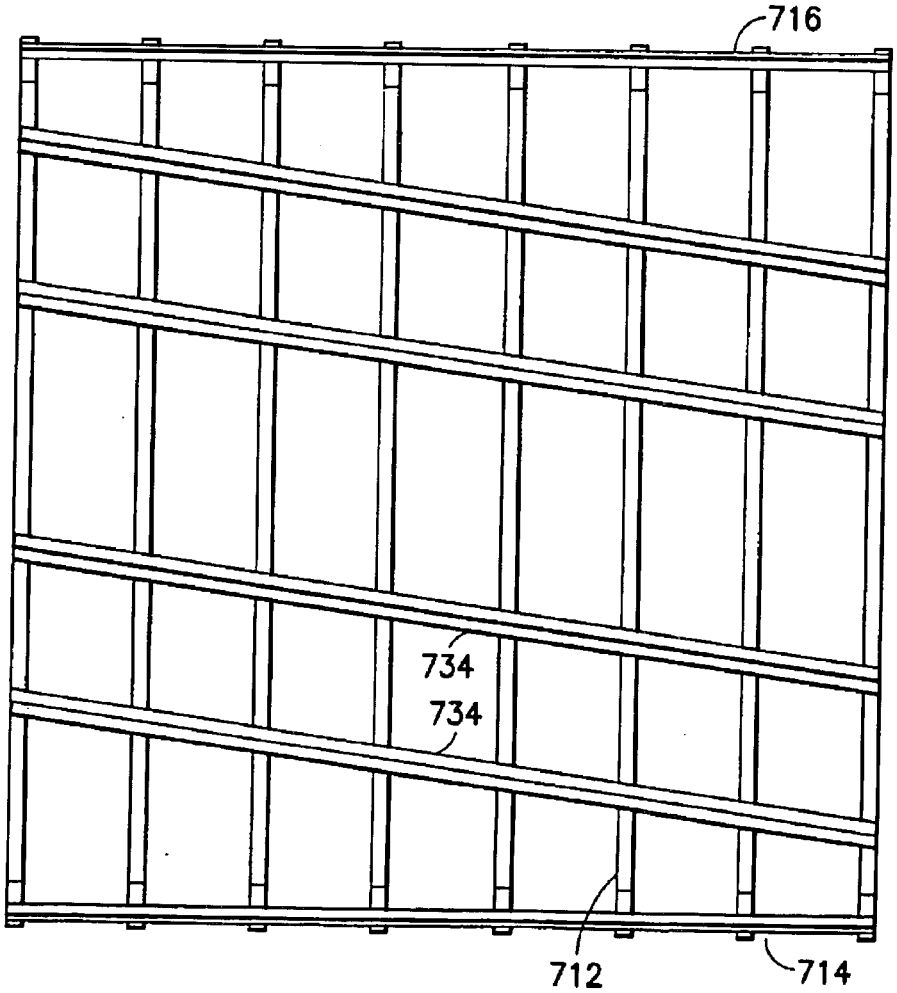
FIG. 7D is a top view of the eighth embodiment shown in FIG. 7C.

FIGS. 7A and 7B illustrate a fireplace grate with one compartment 750 defined by the grate members 712. FIGS. 7C and 7D illustrate a fireplace grate with two compartments 750 defined by the grate members 712.

As illustrated in FIGS. 7A–7D, the front and rear ends of the grate members extend upwardly to cross members 714, 716 to prevent wood or ceramic logs from falling off the front and back of the fireplace grate. Additional cross members may be provided for stability and rigidity. The fireplace grates shown FIGS. 7A and 7C also include front and rear legs 752, 754 to lift the fireplace grate off the floor of a fireplace.

It will be apparent to those skilled in the art that various modifications and variations can be made in the device of the present invention without departing from the spirit or scope of the invention. Thus, it is intended that the present invention embraces all such modifications and variations within the spirit and scope of the appended claims.

I claim:

1. A fireplace grate comprising a frame including a plurality of non-moveable grate members and a plurality of non-moveable cross members, said grate members and said cross members defining a platform and a compartment disposed below the platform, said grate members having first portions lying in a first plane to form the platform and second portions extending below the platform to form the compartment, the first portions of the grate members extending less than the entire length of the frame such that the platform has an opening that provides access to the compartment, the frame further comprising a supporting member extending along the compartment, the compartment operative to hold substantially horizontally a firelog and to prevent direct contact between the firelog and a wood log held substantially horizontally on top of the platform.

2. The fireplace grate of claim 1, wherein the frame includes a base defining a cavity, the frame further including a cage member positioned on the base to further enclose the compartment.

3. The fireplace grate of claim 2, wherein the cage member is hinged to the base.

4. The fireplace grate of claim 2, wherein the base is formed by the plurality of non-moveable grate members connected by the plurality of non-moveable cross members, and wherein the non-moveable grate members include a U-shaped portion for supporting the firelog.

5. The fireplace grate of claim 2, wherein the base is formed by the plurality of non-moveable grate members connected by the plurality of non-moveable cross members, and wherein the non-moveable grate members include a V-shaped portion for supporting the firelog.

6. The fireplace grate of claim 1, wherein the firelog is a gel log.

7. The fireplace grate of claim 1, further comprising a plurality of compartments defined by the frame for holding a plurality of firelogs.

8. The fireplace grate of claim 3, further comprising a removable handle for moving the hinged cage member.

9. The fireplace grate of claim 2, wherein the cage member includes a hinged door.

10. The fireplace grate of claim 1, wherein the platform includes at least four non-moveable grate members of the frame.

11. The fireplace grate of claim 1 wherein at least two of the non-moveable cross members are positioned on the platform proximate the opening in the platform to the compartment.

12. The fireplace grate of claim 11 wherein at least one the cross members extends along the interior of the cavity.

13. A fireplace grate comprising a frame including a plurality of non-moveable moveable grate members and a plurality of non-moveable cross members linked to the grate members, each grate member having first portions extending in a first substantially horizontal plane and a shaped portion deviating below the first substantially horizontal plane via a gap between the first portions, the non-moveable cross members and the grate members defining a platform and a compartment disposed below the platform, the compartment accessible via the gaps in the first portions that define the platform, and further comprising a supporting member extending across the compartment, the compartment operative to hold a starter material in a second substantially horizontal plane and to prevent direct contact between the starter material and a wood log placed on top of the platform and held on the first substantially horizontal plane.

14. The fireplace grate of claim 13 wherein the shaped portion of the grate members is U-shaped or V-shaped.

15. A fireplace grate, said fireplace grate comprising:

a base formed by a plurality of non-moveable grate members, a plurality of non-moveable cross members, and a supporting member, the grate members having a first portion extending in a first plane and a shaped portion extending below the first plane, the grate members connected by the cross members to define a platform and a compartment disposed below the platform, the supporting member extending along the bottom of the compartment, said base for supporting a firelog in the compartment and a log on the platform;

at least one pivot arm; and at least one ceramic log pivotally attached to the base by the at least one pivot arm, wherein the at least one ceramic log pivots between a first and second position, wherein the first position permits the insertion of the firelog into the compartment of the base, and wherein the second position further encloses the compartment and prevents direct contact between the firelog and wood or ceramic logs placed on the platform of the base.

16. The fireplace grate of claim 15 wherein the shaped portion of the grate members is U-shaped or V-shaped.

17. A fireplace grate, said fireplace grate comprising:

a base formed by a plurality of non-moveable grate members, a plurality of non-moveable cross members, and a supporting member, the grate members having a first portion extending in a first plane and a shaped portion extending below the first plane, the grate members connected by the cross members to define a platform and a compartment disposed below the platform, the supporting member extending along the bottom of the compartment, said base for supporting a firelog in the compartment and a log on the platform; and at least one ceramic log hinged to the base, wherein the at least one ceramic log hinges between a first and second position, wherein the first position permits the insertion of the firelog into the compartment of the base, and wherein the second position further encloses the compartment and prevents direct contact between the firelog and wood or ceramic logs placed on the platform of the base.

18. A fireplace grate comprising:

a base including a first plurality of non-moveable grate members spaced apart from each other, each grate member having first portions that extend in a first substantially horizontal plane and that are separated by a gap, and a shaped portion that deviates below the first substantially horizontal plane at the gap between the first portions to links the first portions, a first plurality of non-moveable cross members linking the first plurality of non-moveable grate members, and a supporting member linking the shaped portion of the first plurality of non-moveable grate members, wherein the base forms a platform for supporting a log on the first substantially horizontal plane and a cavity depending from the platform for supporting a firelog or starter material in a second substantially horizontal plane, the cavity accessible through the first substantially horizontal plane via the gaps between the first portions of the first plurality of non-moveable grate members.

19. The fireplace grate of claim 18 wherein the fireplace grate further includes a cage member including a second plurality of non-moveable grate members spaced in a parallel relation, and a second plurality of non-moveable cross members linking the second plurality of non-moveable grate members, wherein the cage member encloses the cavity to form a substantially enclosed compartment that separates the log from the firelog or starter material.

20. The fireplace grate of claim 18 further comprising:

a ceramic log connected to the base, wherein the ceramic log moves between a first position and a second position, wherein the first position permits insertion of the firelog or the starter material into the cavity, and wherein the second position substantially encloses the cavity and prevents contact between the firelog and wood or ceramic logs placed on top of the platform.

21. The fireplace grate of claim 18 wherein the shaped portion of the grate members is U-shaped or V-shaped.

22. A fireplace grate comprising:

a plurality of grate members, each grate member having first portions extending in a first plane and a second portion extending from the first portions, the second portion deviating below the first plane at a gap between the first portions which forms an opening in the first plane; and a plurality of cross members linking the plurality of grate members to form a platform and a cavity disposed below the platform, the opening in each of the plurality of grate members aligned to provide access to the cavity through the first plane, wherein the platform is operative to hold a wood log in a first substantially horizontal plane and the cavity is operative to hold a firelog in a second substantially horizontal plane.

* * * * *